United States Patent [19]

Jensen

[11] 4,169,710

[45] Oct. 2, 1979

[54] PROCESS FOR COMMINUTING AND REDUCING THE SULFUR AND ASH CONTENT OF COAL

[75] Inventor: Harbo P. Jensen, San Rafael, Calif.

[73] Assignee: Chevron Research Company, San Francisco, Calif.

[21] Appl. No.: 891,569

[22] Filed: Mar. 29, 1978

[51] Int. Cl.[2] ..... C10L 9/10; C10B 57/00; B02C 19/00

[52] U.S. Cl. ..... 44/1 SR; 201/17; 241/1

[58] Field of Search ..... 44/1 R; 201/17; 241/1

[56] References Cited

U.S. PATENT DOCUMENTS

| | | | |
|---|---|---|---|
| 3,850,447 | 11/1974 | Aldrich et al. | 299/5 |
| 3,863,846 | 2/1975 | Keller et al. | 241/1 |
| 3,870,237 | 3/1975 | Aldrich | 241/1 |
| 3,918,761 | 11/1975 | Aldrich | 299/5 |
| 4,071,328 | 1/1978 | Sinke | 44/1 R |
| 4,083,940 | 4/1978 | Das | 44/1 R |

*Primary Examiner*—Carl Dees

*Attorney, Agent, or Firm*—D. A. Newell; R. H. Davies; R. H. Evans

[57] ABSTRACT

Coal may be effectively comminuted and the ash and sulfur content thereof reduced by contacting the coal with a hydrogen halide such as HF.

7 Claims, 1 Drawing Figure

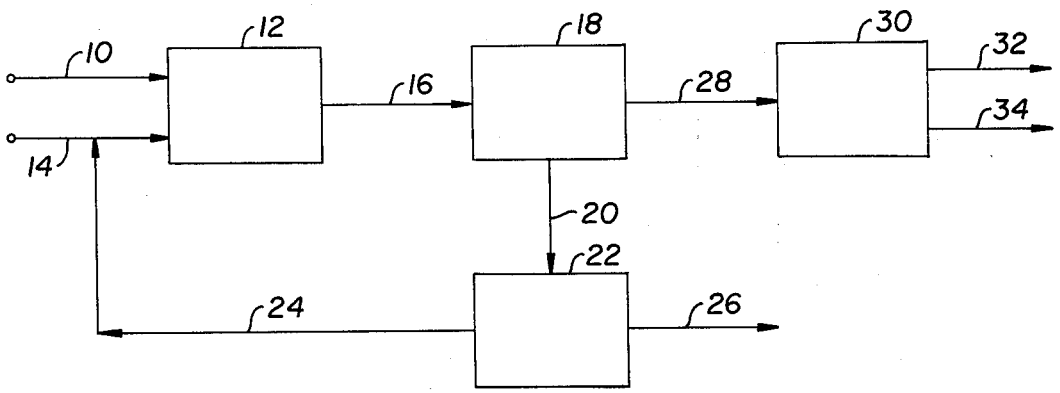
10
12
16
18
28
30
32
34
14
20
22
24
26

PROCESS FOR COMMINUTING AND REDUCING THE SULFUR AND ASH CONTENT OF COAL

BACKGROUND OF THE INVENTION

1. Field of the Diclosure

The present invention relates to a process for comminuting and reducing the sulfur and ash content of coal.

2. Description of the Prior Art

Coal is our most abundant indigenous fossil fuel resource, and should accordingly play a major role in meeting future energy needs. Environmental standards promugated to regulate stack emissions, however, currently prohibit use of much of the United States coal in power plants without pretreatment or stack gas effluent control to reduce atmospheric contaminants to an acceptable level. High-sulfur and high-ash coals are particularly burdensome fuels due to limits imposed on sulfur dioxide and particulate emissions. The principal sulfur-bearing mineral in coal, pyrite, can be partially removed from some coals by conventional preparation techniques, such as crushing and density separations. However, the process efficiency of these techniques is dependent upon the size distribution of the pyrite in the coal. For applicable coals, crushing the coal to particles in the size range of 1½ inches to 100 mesh will normally suffice; but, if the coal particle size is less than 100 mesh, the difficulties of materials handling, separation and storage become prohibitive. The primary burden of controlling sulfur emissions for such coals must then be met with costly sulfur dioxide scrubbers.

Coal may be converted directly to combustible gases or synthetic crude oil by a number of processes. The conversion processes, however, must also cope with the sulfur and ash content of the raw coal. The contaminants create problems, not only in the final product, but during the processing of the coal. Difficult processing problems involve $H_2S$ production and removal, catalyst poisoning and fouling, corrosion, and equipment plugging. Furthermore, many of the commercially feasible systems for coal gasification or coal liquefaction require that the raw coal be initially prepared by extensive comminution, thus substantially increasing the over-all system capital and operating costs. As a result of the aforementioned problems, research efforts have been directed towards the pretreatment of coal for both comminution purposes and impurities control.

The prior art teaches that large coal fragments may be "chemically" comminuted to a finely divided coal product by exposing the coal to liquid or gaseous ammonia, methanol, or numerous other organic compounds having a molecular weight less than 100 . The pressures, temperatures, and exposure times appear to be noncritical as long as the comminuting agent has had sufficient time to impregnate the coal. Some inventors have postulated that the comminuting agent penetrates the coal structure along the bedding planes and structural defects of the coal and weakens the atomic bonding of the coal interfacial areas by substituting a boundary surface which has little attractive force for the counterpart surface. Chemical comminution does appear to be primarily a physical phenomenon, as little or no comminuting agent is consumed in the process and the coal remains essentially unchanged other than being reduced in size. After comminution of the coal, various conventional classifications or density separation techniques may be used to separate the heavier ash and the heavier, and sometimes larger, pyritic materials from the fine coal particles. Due to the lack of chemical effect on the liberated impurities, any reduction in contaminant level is governed solely by the efficiency of separation of the coal particles from the impurities, as in the mechanical crushing procedures.

SUMMARY OF THE INVENTION

A process is disclosed for comminuting coal, which comprises treating said coal with a hydrogen halide. Said hydrogen halide may be used in either an anhydrous state or aqueous solution. A particularly preferred hydrogen halide for use in the process is HF.

In accordance with one embodiment of the invention, coal, containing sulfur and ash, is treated with hydrogen halide, which may be either in an aqueous or anhydrous state, to produce fine coal particles substantially liberated from at least a portion of said sulfur and ash and to convert at least a portion of said sulfur and ash to solubles dissolved in said hydrogen halide. The hydrogen halide and dissolved solubles are then separated from the fine coal particles and remaining sulfur and ash. The process may further include recycling at least a portion of the hydrogen halide and dissolved solubles for use in the treating step. The hydrogen halide may also be separated from the dissolved solubles prior to recycle.

BRIEF DESCRIPTION OF THE DRAWINGS

The drawing diagrammatically illustrates a comminution system arranged in accordance with one embodiment of the present invention.

DETAILED DESCRIPTION OF THE PREFERRED EMBODIMENTS

Referring to the drawing, raw coal is introduced by conventional means through line 10 to a treatment zone 12. A hydrogen halide, such as anhydrous HF, is also introduced to the treatment zone 12 through line 14. In the treatment zone the coal and hydrogen halide are intimately contacted for a sufficient length of time to permit the hydrogen halide to impregnate the coal and comminute same, reducing the sulfur and ash content, and substantially liberating the remaining pyrites and ash from the resulting fine coal particles. The resulting mixture of comminuted coal particles, hydrogen halide containing dissolved impurities, and the remaining ash and pyritic particles are passed from the treatment zone 12 via line 16 to a first separation zone 18. In separation zone 18, the hydrogen halide, and dissolved impurities, are separated from the coal particles, ash and pyrites by conventinal means such as filters or centrifuges.

The separated hydrogen halide and dissolved impurities pass from zone 18 through line 20 to a purification zone 22 wherein the dissolved impurities are separated from the hydrogen halide. The clean hydrogen halide is passed through line 24 to line 14 for recycle to the treating zone and the impurities are removed from the system via line 26. Fine coal particles and the remaining ash and pyrites are removed from separation zone 18 through line 28 to a second separation zone 30. In zone 30, a portion of the pyrites and ash is separated from the fine coal particles by conventional techniques and exits from the system through line 32. The fine coal particles are removed from zone 30 through line 34 for further processing or direct use.

It has been discovered that hydrogen halides are capable of comminuting raw chunk coal to fine coal particcles which are substantially liberated from any pyrites or ash originally contained in the larger coal fragments. Similarly to the chemical comminution processes disclosed in the prior art, no precise time, temperature or pressure can be specified for the impregnation of the coal by the hydrogen halide, as same is largely dependent upon the morphology of the coal comminuted.

HF is particularly effective as a comminuting agent. Some coals which are hardly affected by $NH_3$ are extensively powdered by HF, and other coals which are slowly comminuted by $NH_3$ appear to crumble instantaneously in HF. Raw Kittanning coal, having a particle size greater than 10 mesh, Tyler Standard Sieve size, was comminuted by liquid anhydrous ammonia and HF. The results of the comminutions are shown in Table I below.

TABLE I

| Particle Size Cut, Tyler Standard Sieve Size | Weight % in Size Cut From $NH_3$ Comminution | Weight % in Size Cut From HF Comminution |
|---|---|---|
| 10-35 | 8.6 | trace |
| 35-60 | 14.4 | 6.8 |
| 60-100 | 41.3 | 19.44 |
| 100-200 | 26.8 | 36.67 |
| <200 | 8.8 | 37.10 |

The tabulated information reveals that approximately 64.3% of the Kittanning coal comminuted with ammonia is larger than 100 mesh, whereas only 26.24% of the coal comminuted with HF is larger than 100 mesh, representing a significant increase in comminution effectiveness.

It is not required, however, that the hydrogen halide be in an anhydrous state for the comminution of coal. 48% HF aqueous solutions and 37% HCl aqueous solutions were also observed to be effective for comminution purposes; however, neither solution appeared to comminute the coal as rapidly as anhydrous HF.

A second important benefit accrues from the use of hydrogen halides, such as HF, for comminution purposes. The hydrogen halide significantly reduces the ash and sulfur content of the resulting comminuted particles. For example, Table II illustrates the reduced ash and sulfur content for three different coals comminuted with anhydrous HF.

TABLE II

| | Ash Content, wt. % | | Sulfur Content, wt. % | |
|---|---|---|---|---|
| Coal | As Received | After HF Comminution | As Received | After Comminution |
| Kittanning | 7.38 | 2.62 | 2.38 | 1.01 |
| River King | 11.89 | 4.99 | 3.82 | 2.80 |
| Pittsburgh Stove | 7.96 | 1.79 | 2.23 | 1.89 |

It should be emphasized that the tabulated reduction in ash and sulfur content does not depend upon subsequent density separation or classification techniques as required in the prior art. The observed sulfur content reduction is believed to occur partly as a result of the conversion of the sulfur to hydrogen sulfide, and the ash content reduction is believed due to the formation of metal fluorides which are dissolved in the hydrogen halide.

The hydrogen halide and any dissolved solubles contained therein are separated from the comminuted coal particles and the remaining ash and pyrites in separation zone 18. Said separation zone will typically comprise filters, centrifuges, driers or a combination thereof. However, for certain downstream applications, such as those processes using molten halide salts, it may be advantageous to purposely leave a portion of the hydrogen halide with the comminuted coal particles.

As a result of the impurities dissolved in the hydrogen halide during the treating step, cleaning of the hydrogen halide stream to remove the contaminants may be required for continuous operation. The entire stream can be wholly or partially cleaned as indicated in the drawing, or, preferably, a slip-stream is cleaned to maintain control of the impurities level of the recycled hydrogen halide.

The sulfur and ash level of the final product may be further lowered by taking advantage of the different specific gravities of the impurities and the resulting coal particles in separation zone 30. Separation zone 30 may be of conventional means such as a float-sink separator or a high-gradient magnetic separation system or, if the coal morphology permits, conventional classificaton or screening apparatus.

What is claimed is:

1. A process for comminuting raw coal, which comprises:

treating said coal with a hydrogen halide at an effective concentration level such that the coal is comminuted.

2. A process for comminuting raw coal containing sulfur and ash, which comprises:

treating said coal with a hydrogen halide in an effective concentration to produce fine coal particles substantially liberated from at least a portion of said sulfur and ash and to convert at least a portion of said sulfur and ash to solubles dissolved in said hydrogen halide; and substantially separating the hydrogen halide and dissolved solubles from the fine coal particles and remaining sulfur and ash.

3. A process as recited in claim 2, which further comprises:

recycling at least a portion of the hydrogen halide and dissolved solubles from the separating step for use in the treating step.

4. A process as recited in claim 2, which further comprises:

separating at least a portion of the dissolved solubles from at least a portion of the hydrogen halide and dissolved solubles from the preceding separation step to produce a hydrogen halide with reduced dissolved solubles; and recycling said hydrogen halide with reduced dissolved solubles for use in the treating step.

5. A process as recited in claim 4, which further comprises:

substantially separating the fine coal particles from the remaining sulfur and ash.

6. A process as recited in claim 2 or claim 3 or claim 4 or claim 5 wherein said hydrogen halide in an effective concentration is an aqueous HF solution having an HF conentration of at least 48 weight percent.

7. A process as recited in claim 2 or claim 3 or claim 4 or claim 5 wherein said hydrogen halide in an effective concentration is an aqueous HCl solution having an HCl concentration of at least 37 weight percent.

* * * * *